US009739585B2

(12) United States Patent
Nugent, Jr. et al.

(10) Patent No.: US 9,739,585 B2
(45) Date of Patent: Aug. 22, 2017

(54) RETRO REFLECTIVE TRACER AMMUNITION, AND RELATED SYSTEMS AND METHODS

(71) Applicants: Thomas J Nugent, Jr., Bellevue, WA (US); Elizabeth Nugent, Bellevue, WA (US); Nicholas R Burrows, Seattle, WA (US); Carsten Erickson, Kent, WA (US); David J Bashford, Kent, WA (US)

(72) Inventors: Thomas J Nugent, Jr., Bellevue, WA (US); Elizabeth Nugent, Bellevue, WA (US); Nicholas R Burrows, Seattle, WA (US); Carsten Erickson, Kent, WA (US); David J Bashford, Kent, WA (US)

( * ) Notice: Subject to any disclaimer, the term of this patent is extended or adjusted under 35 U.S.C. 154(b) by 987 days.

(21) Appl. No.: 13/924,419

(22) Filed: Jun. 21, 2013

(65) Prior Publication Data

US 2016/0209188 A1 Jul. 21, 2016

Related U.S. Application Data

(60) Provisional application No. 61/662,821, filed on Jun. 21, 2012.

(51) Int. Cl.

| | |
|---|---|
| ***F42B 10/00*** | (2006.01) |
| ***F42B 12/38*** | (2006.01) |
| ***F42B 5/16*** | (2006.01) |

(52) U.S. Cl.

CPC ..... *F42B 12/387* (2013.01); *F42B 5/16* (2013.01)

(58) Field of Classification Search

CPC ..... F42B 12/387; F42B 12/38; F42B 12/382; F42B 5/02

USPC ..... 102/439

See application file for complete search history.

(56) References Cited

U.S. PATENT DOCUMENTS

| | | | | |
|---|---|---|---|---|
| 3,954,228 A * | 5/1976 | Davis, Jr. | F41G 7/2213 | 244/3.16 |
| 4,015,258 A * | 3/1977 | Smith | F41G 3/06 | 342/119 |
| 4,040,744 A * | 8/1977 | Schertz | F41G 3/225 | 244/3.16 |
| 4,047,816 A * | 9/1977 | Pell | G01B 11/26 | 250/203.2 |
| 4,448,106 A * | 5/1984 | Knapp | F42B 12/40 | 102/501 |

(Continued)

*Primary Examiner* — Samir Abdosh

(74) *Attorney, Agent, or Firm* — Janeway Patent Law PLLC

(57) ABSTRACT

A projectile includes a component that is highly reflective and configured to reveal the projectile's trajectory when the projectile is fired from a gun and electromagnetic radiation is directed toward the projectile. With the reflective component, one can more easily limit the visibility of the projectile to areas from where the projectile was fired because the reflective component is passive, not active. As the projectile moves down range, the areas behind the projectile are typically where a shooter and/or spotter for the shooter are located, not where an enemy combatant is located. Thus, the trajectory of the projectile is revealed to the people who can use the information to adjust their fire, and remains hidden from the people who could use the information to locate the shooter.

21 Claims, 6 Drawing Sheets

(56) References Cited

U.S. PATENT DOCUMENTS

| | | | | |
|---|---|---|---|---|
| 5,639,984 | A * | 6/1997 | Nielson | C06B 43/00 102/336 |
| 9,316,593 | B2 * | 4/2016 | Switkes | G01N 21/78 |
| 2004/0099173 | A1 * | 5/2004 | Rector | F42B 12/382 102/501 |
| 2013/0015977 | A1 * | 1/2013 | Scott | G01S 17/74 340/600 |
| 2015/0308802 | A1 * | 10/2015 | Chua | F42B 12/382 102/513 |
| 2016/0161217 | A1 * | 6/2016 | Sullivan | F41G 3/142 89/41.05 |

* cited by examiner

RETRO REFLECTIVE TRACER AMMUNITION, AND RELATED SYSTEMS AND METHODS

CROSS REFERENCE TO RELATED APPLICATION AND CLAIM OF PRIORITY

This application claims priority from commonly owned U.S. Provisional Patent Application 61/662,821 filed 21 Jun. 2012, and titled "RETRO-REFLECTIVE TRACER AMMUNITION", which is incorporated by reference.

BACKGROUND

Tracer ammunition allows one to track the trajectory of one or more bullets that one has just fired so that one can adjust one's aim. Historically, tracer ammunition has used pyrotechnic material (such as phosphorous or magnesium) that is ignited as the bullet is fired, and glows or emits visible light that can be seen as the bullet travels.

Unfortunately, using such tracer ammunition causes problems. One of the biggest problems is that the burning pyrotechnic material is visible in all directions. This enables enemy combatants to back-trace the path of the tracer bullet to its origin, and thus exposes the position of the shooter to enemy combatants. Also, allied combatants, such as all the combatants in a company, may have trouble distinguishing their own tracers from their allies' tracers. In addition, with pyrotechnic material the mass and density of the tracer bullet is different than the other non-tracer bullets that the tracer's trajectory is supposed to mimic, and thus does not accurately show the trajectory of the non-tracer bullet. This is true when the tracer is first fired out of a gun because the pyrotechnic material does not have the same mass as the material of the bullet (often lead) that the pyrotechnic material replaces. This is also true while the tracer travels down range because as the pyrotechnic material burns, the mass of pyrotechnical material decreases. This change in mass affects the ballistics of the tracer and can cause the shooter to misjudge the trajectory of the non-tracer bullets. Finally, pyrotechnic material creates a fire hazard upon impact, which may create problems during a training exercise or other similar situations.

Some tracer ammunition reduces the visible light component of the pyrotechnic material so that the tracer is only visible via a night-vision goggle (NVG). This solution works when an enemy combatant does not have a night-vision goggle, but does not work well in daylight. Furthermore, many consumer-grade cameras can see in the near-infrared spectrum (where NVGs operate) and thus allow enemy combatants to track such tracers.

Other tracers include an LED or diode laser, power source, and switch mounted onto a bullet to emit light backwards toward the shooter. But such tracers are difficult and complex to make because the light source, power source and switch are bulky relative to the bullet that they're mounted onto. This bulk also dramatically changes the ballistics of the tracer which causes the tracer's trajectory to not mimic the non-tracer's trajectory. In addition, the light emitted from the LED or diode laser is often visible from locations remote from the shooter. This is especially true when the tracer wobbles or tumbles during flight.

SUMMARY

In an aspect of the invention, a projectile includes a component that is highly reflective and configured to reveal the projectile's trajectory when the projectile is fired from a gun and electromagnetic radiation is directed toward the projectile. With the reflective component, one can more easily limit the visibility of the projectile to areas from where the projectile was fired because the reflective component of the projectile is passive, not active. As the projectile moves down range, the areas behind the projectile are typically where a shooter and/or spotter for the shooter are located, not where an enemy combatant is located. Thus, the trajectory of the projectile is revealed to the people who can use the information to adjust their fire, and remains hidden from the people who could use the information to locate the shooter. Specifically, an enemy combatant would not know where to direct electromagnetic radiation to cause a reflection and thus reveal the trajectory of the projectile. Active components generate electromagnetic radiation and emit the radiation perpendicular as well as parallel to the projectile's trajectory, and thus reveal the trajectory to many people other than the shooter.

In another aspect of the invention, the highly reflective component includes a retroreflector that is configured to reflect much of the electromagnetic radiation directed toward the projectile directly back toward the source of the electromagnetic radiation, and none or substantially none of the electromagnetic radiation toward areas adjacent the source of the electromagnetic radiation. With the retroreflector, electromagnetic radiation may be used to reveal the projectile's trajectory to the shooter even when the projectile wobbles or tumbles during flight.

DETAILED DESCRIPTION

Figure 1:
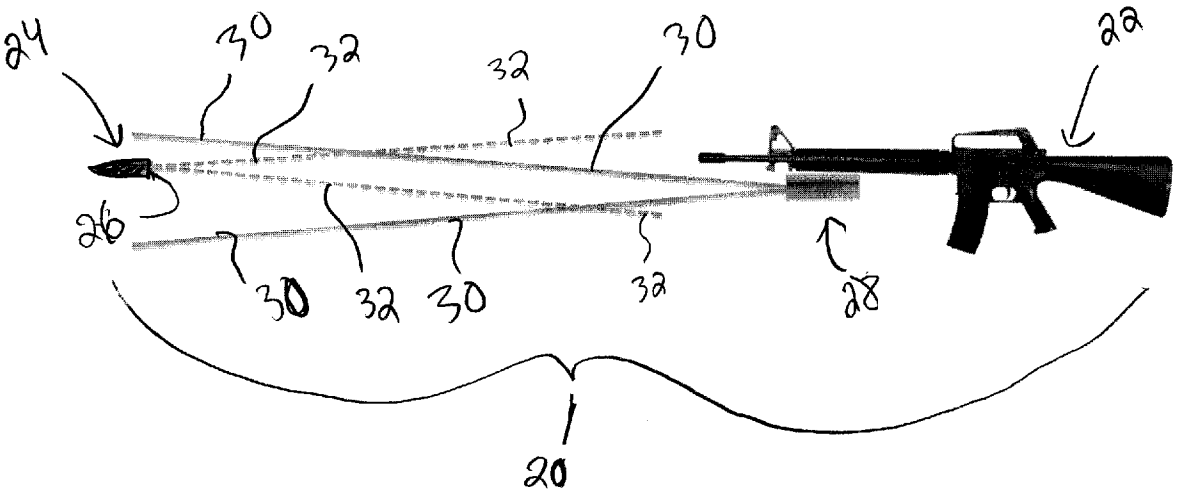
FIG. 1 shows a view of a system for revealing a projectile's trajectory when the projectile is fired from a gun, according to an embodiment of the invention.

FIG. 1 shows a view of a system 20 for revealing a projectile's trajectory when the projectile is fired from a gun 22, according to an embodiment of the invention. Here the gun 22 is an M16 but the gun 22 may be any desired gun, such as a handgun, rifle, machine gun, or cannon. The system 20 includes a projectile 24 that has a highly reflective component 26, and an illuminator 28. The illuminator 28 generates electromagnetic radiation and directs the electromagnetic radiation toward the projectile 24 while the projectile 24 travels away from the gun 22. The highly reflective component 28 reflects some of the electromagnetic radiation that the illuminator 28 directs toward the projectile 24, back toward the gun 22 to allow the shooter (not shown) or another person (also not shown) close to the shooter, such as a spotter for a sniper, to track the projectile's trajectory.

Once the projectile's trajectory is known, the shooter can adjust his aim to achieve his desired effect.

With the highly reflective component 26, one can more easily limit the visibility of the projectile 24 to areas from where the projectile 24 was fired because the highly reflective component 26 of the projectile is passive, not active. As the projectile 24 moves down range, the areas behind the projectile are typically where a shooter and/or spotter for the shooter are located, not where an enemy combatant is located. Thus, the trajectory of the projectile is revealed to the people who can use the information to adjust their fire, and remains hidden from the people who could use the information to locate the shooter. Specifically, an enemy combatant would not know where to direct electromagnetic radiation to cause a reflection to reveal the trajectory of the projectile 24. Active components generate electromagnetic radiation and emit the radiation perpendicular as well as parallel to the projectile's trajectory, and thus reveal the trajectory to many people other than the shooter.

The illuminator 28 (discussed in greater detail in conjunction with FIG. 6) may generate any desired electromagnetic radiation. For example, in this and other embodiments the illuminator 28 generates light in the visible spectrum that can be seen with the unaided eye and light in the near-infrared spectrum that can be seen with conventional night vision googles. By using visible light and near-infrared light, the system 20 can be used during the day without the shooter and/or spotter requiring special equipment to sense or see the reflection. In the chaos of a battle, such equipment can hinder the shooter and/or spotter's ability to see everything around him/her, and thus hinder the shooter and/or spotter's ability to appropriately react to a threat. By using the near-infrared light, the system can also be used during the night. With near-infrared light one must have night vision goggles to sense or see the electromagnetic radiation reflected from the projectile 24, and thus the reflection from the projectile 24 is less likely to be sensed or seen by an enemy combatant. And although the shooter and/or spotter would require night vision goggles to sense or see the reflection, such equipment would not hinder the shooter and/or spotter because the shooter and/or spotter typically cannot see during the night without a visual aid.

The illuminator 28 also may direct the electromagnetic radiation in any desired form. For example, in this and other embodiments the illuminator 28 collimates the electromagnetic radiation into a laser beam. By doing this, much of the electromagnetic radiation is directed at the projectile 24 which allows the highly reflective component 26 to reflect enough of the electromagnetic radiation back to the shooter and/or spotter to allow the shooter and/or spotter to easily sense or see the reflection especially over a long distance.

Other embodiments are possible. For example, the illuminator 28 may generate electromagnetic radiation in the infrared, radio wave, ultraviolet, and or x-ray spectrum. Also, the illuminator 28 may direct the electromagnetic radiation without collimating it, such as a flashlight that generates visible light.

Still referring to FIG. 1, the projectile 24 (discussed in greater detail in conjunction with FIGS. 3-5) may include any desired highly reflective component 26. For example, in this and other embodiments the highly reflective component 26 includes a retroreflector that reflects electromagnetic radiation back to its source with minimal diffusion or scattering of the radiation. In other embodiments, such as the ones discussed in conjunction with FIG. 4, the highly reflective component 26 includes a plurality of retroreflectors. As discussed in conjunction with FIG. 3, a retroreflector reflects electromagnetic radiation parallel to but opposite in direction from the source of the electromagnetic radiation, and does this independent of the angle that the electromagnetic radiation hits the retroreflector's reflecting surface. With the retroreflector, most of the electromagnetic radiation that reaches the highly reflective component 26 is reflected back toward the shooter and/or spotter, which also allows the shooter and/or spotter to easily sense or see the reflection especially over a long distance.

Other embodiments are possible. For example, the highly reflective component 26 may include a highly polished flat surface or facet, such as a mirror, of the projectile 24 capable of reflecting a very high percentage of the electromagnetic radiation that it receives back toward the gun 22 without much diffusion or scattering. Unlike a retroreflector, though, if the projectile wobbles or tumbles during flight much of the electromagnetic radiation received by the highly reflective component 26 will not be reflected back to the shooter, but elsewhere.

In operation, a shooter may fire multiple projectiles from the gun 22 of which one or more may be a projectile 24 that includes the highly reflective component 26. In this and other embodiments, as the shooter fires the projectiles that do not include the highly reflective component 26, the illuminator 28 remains "off", that is, does not generate electromagnetic radiation and does not direct the radiation toward each projectile as each travels down range. Then, as the shooter fires the projectile 24 that does include a highly reflective component 26, the illuminator 28 is turned "on", that is, does generate electromagnetic radiation 30 and does direct the radiation 30 toward the projectile 24 as the projectile 24 travels down range. Some of the radiation 30 reaches the highly reflective component 26 of the projectile 24 and is reflected back toward the shooter. Some of the reflected radiation 32 is then seen or sensed by the shooter. To track the trajectory of the projectile 24, and thus infer the trajectory of the other projectiles previously fired, the shooter observes the movement of the reflected radiation 32.

Figure 2:
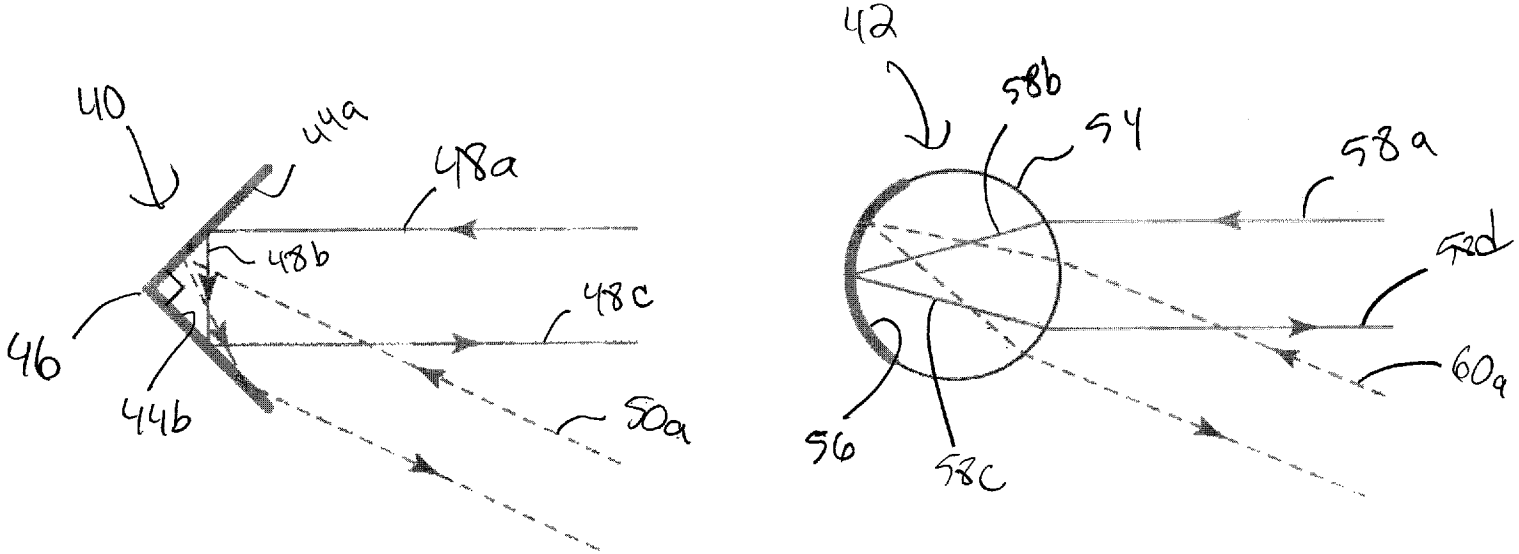
FIG. 2 shows two retroreflectors, each different than the other.

FIG. 2 shows two retroreflectors 40 and 42, each different than the other. Although the retroreflectors 40 and 42 are different, their respective results are very similar. They both reflect electromagnetic radiation parallel to but opposite in direction from the source of the electromagnetic radiation, independent of the angle that the electromagnetic radiation hits the retroreflector.

The first retroreflector 40 is a corner reflector. The corner reflector 40 includes three reflecting surfaces two of which are labeled 44*a* and 44*b*, respectively, and the third of which has been omitted for clarity. In three dimensions, the three surfaces intersect to form a corner 46, and thus the third surface lies parallel to the page on which FIG. 2 is printed. Although the operation of the corner reflector 40 is shown in two dimensions, the corner reflector 40 operates in a very similar manner in three dimensions. Specifically, electromagnetic radiation 48*a* hits the reflecting surface 44*a* and is reflected by the surface 44*a* toward the surface 44*b*. The reflected radiation 48*b* hits the surface 44*b* and is reflected by the surface 44*b*. The reflected radiation 48*c* travels back toward the source of the radiation 48*a* in a direction parallel to the direction that the radiation 48*a* travels. Similarly, the electromagnetic radiation 50*a* traveling to the corner reflector 40 is reflected by the surface 44*a* and then reflected by the surface 44*b* back toward the source of the radiation in a direction parallel to the direction that the radiation 50*a* travels. The angle that each wave of radiation 48*a* and 50*a* hits the surface 44*a* is different yet the corner reflector 40 reflects each back toward its respective source in a direction parallel to its respective incoming radiation 48*a* and 50*a*. In three dimensions, the incoming radiation may be reflected from each of the three reflecting surface before it travels back toward the radiation's source in a parallel direction.

The second retroreflector 42 is a cat-eye reflector. The cat-eye reflector 42 includes a refracting element 54, typically a glass sphere, and a reflective surface 56, typically a spherical mirror, located at the focal surface of the refractive element 54. When electromagnetic radiation 58*a* hits the refracting element 54, the radiation 58*a* is refracted toward the reflective surface 56. When the refracted radiation 58*b* hits the surface 56, the surface reflects the radiation back toward the source of the radiation. When the reflected radiation 58*c* leaves the refracting element 54, the radiation 58*c* is refracted. The refracted radiation 58*d* travels back toward the source of the radiation 58*a* in a direction parallel to the direction that the radiation 58*a* travels. Similarly, the electromagnetic radiation 60*a* traveling to the cat-eye reflector 42 is refracted by the element 54; then reflected by the surface 56; and then refracted back toward the source of the radiation in a direction parallel to the direction that the radiation 60*a* travels. The angle that each wave of radiation 58*a* and 60*a* enters the refractive element 54 is different yet the cat-eye reflector 42 refracts and reflects each back toward its respective source in a direction parallel to its respective incoming radiation 58*a* and 60*a*.

Still referring to FIG. 2, the highly reflective component 26 (FIG. 1) may include either or both of the corner reflector 40 and the cat-eye reflector 42. If the projectile 24 (FIG. 1) is to travel a long distance, such as 200 or more yards, and the observer is the shooter or very close to the shooter, then a corner reflector 40 might be desirable. However, if the observer is not located close to the shooter, then the cat-eye reflector 42 might be desirable.

Other embodiments are possible. For example, the highly reflective component 26 may include a phase-conjugate retroreflector.

Figure 3:
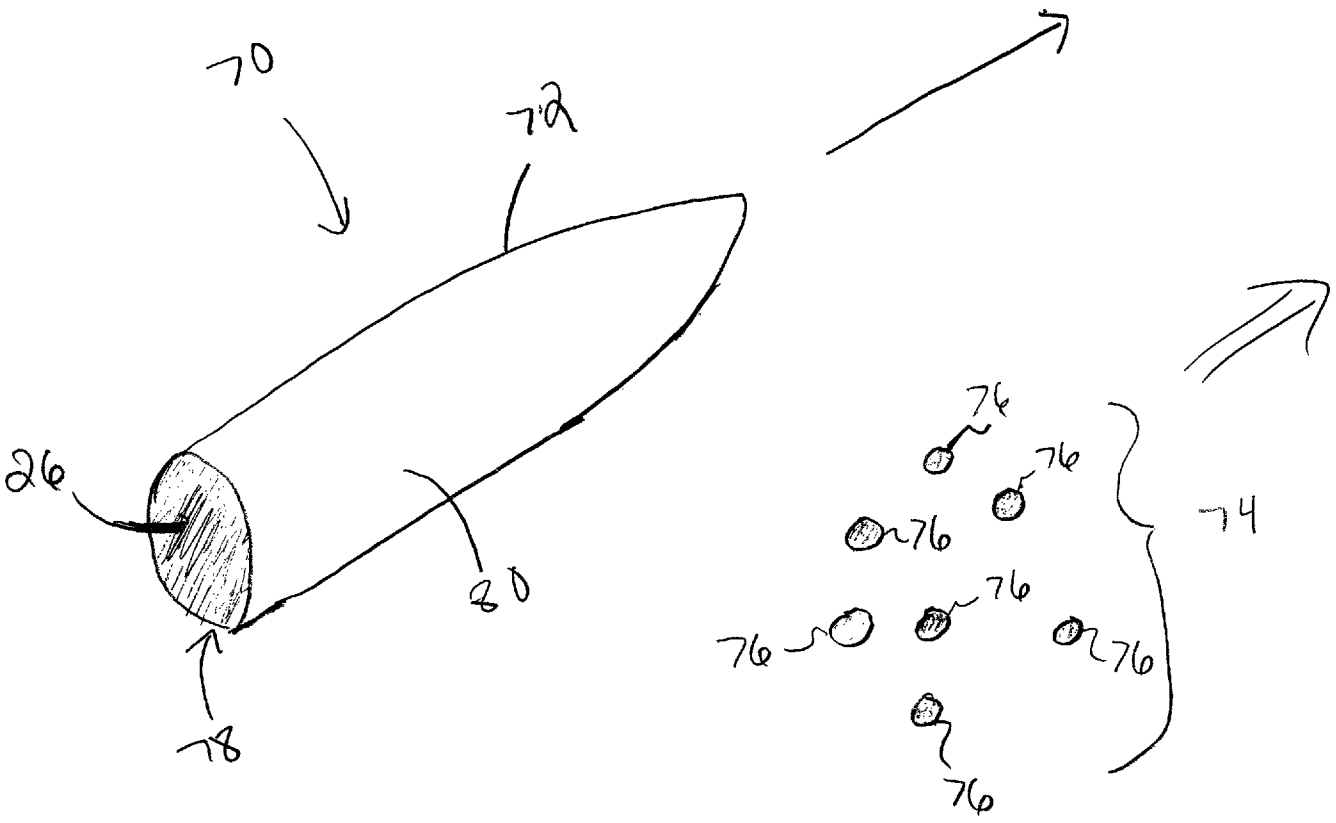
FIG. 3 shows two perspective views of a projectile, each according to an embodiment of the invention.

FIG. 3 shows two perspective views of a projectile, each according to an embodiment of the invention. In the first and other embodiments, the projectile 70 includes a body 72 that is a solid mass of metal. And in the second and other embodiments, the projectile 74 includes a plurality of bodies 76. The projectile 70 is configured to be fired from a rifle or handgun, such as a 30-06 rifle, 7.62 mm rifle, 45 caliber pistol, or 9 mm pistol. The projectile 74 is configured to be fired from a shotgun.

In these and other embodiments, the highly reflective component 26 may be located as desired on the respective bodies 72 and 76. For example, the body 72 of the projectile 70 includes a region 78 that is the rear of the projectile, i.e., that leaves the gun last when gun fires the projectile 70; and the highly reflective component 26 covers the region 78. In other embodiments of the projectile 70, the highly reflective component 26 may be located on the side 80, a portion of the side 80, the front 82 of the projectile's body 74, and/or a portion of the front 82, in addition to or in lieu of being located on the rear region 78. In this and other embodiments of the projectile 74, each of the bodies 76 may be completely covered by a highly reflective component 26. In other embodiments of the projectile 74, one or more of the bodies may be completely or partially covered by a highly reflective component 26.

In these and other embodiments, the highly reflective component 26 may be fastened as desired to the bodies 72 and 76 of the projectiles 70 and 74, respectively. For example, in these and other embodiments the highly reflective component 26 includes a tape that has a retroreflector and adheres to the region 78 of the projectile 70 or to each body 76 of the projectile 74. In other embodiments, the highly reflective component 26 may be embossed on the respective bodies 72 and 76 of the projectiles 70 and 74. In such embodiments, the embossed structure may be plated with a very reflective metal to increase the component's reflectivity.

Figure 4:
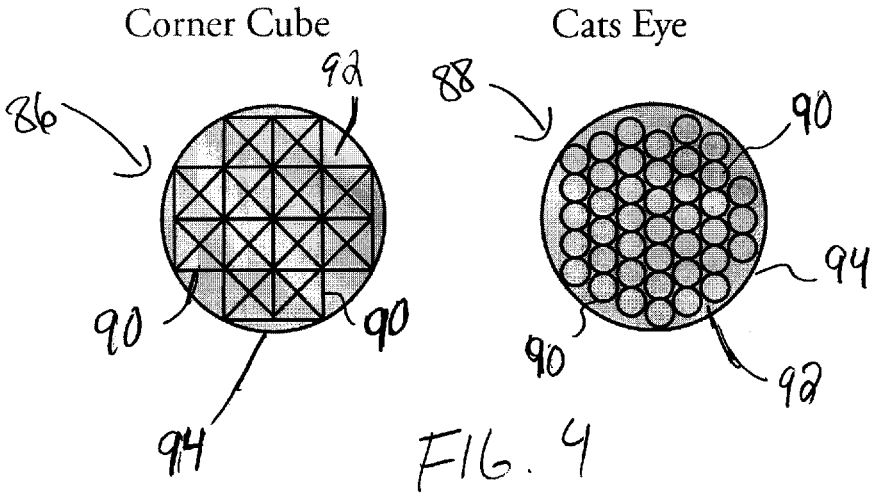
FIG. 4 shows two arrangements of retroreflectors disposed on a projectile, each according to an embodiment of the invention.

FIG. 4 shows two arrangements 86 and 88 of retroreflectors 90 that comprise a highly reflective component 92 of a projectile 94, each arrangement according to an embodiment of the invention. The retroreflectors 90 may be arranged as desired to provide an adequate reflection as the projectile 94 travels down range. For example, in these and other embodiments, the retroreflectors 90 are tiled on the region of the projectile 94 to maximize the number of retroreflectors 90 included in the highly reflective component 92. In other embodiments, the retroreflectors may be arranged in a specific geometric shape such as a circle or a cross. Also, although the highly reflective component 92 of each projectile 90 includes a plurality of a single type of retroreflector, the highly reflective component 92 may include any desired combination of any retroreflectors, or of any retroreflectors and non-retroreflector reflectors.

Figure 5:
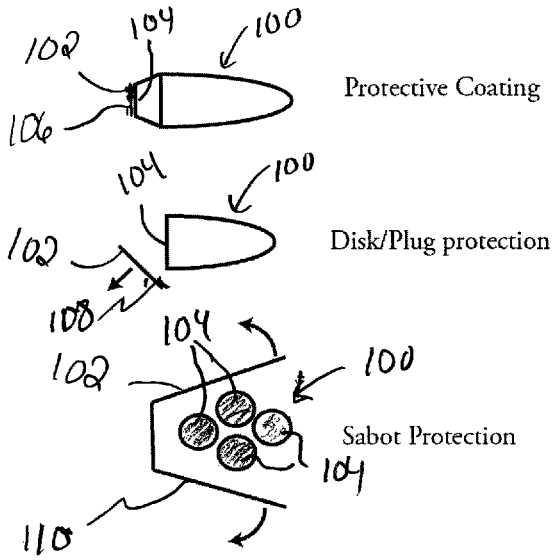
FIG. 5 shows three views of a projectile that includes a protective component, each according to an embodiment of the invention.

FIG. 5 shows three views of a projectile 100 that includes a protective component 102, each according to an embodiment of the invention. The protective component 102 protects the highly reflective component 104 while the projectile 100 is urged out of a gun.

The protective component 102 may be any desired structure capable of performing this function. For example, the protective component 102 may include a wax coating 106 that isolates the highly reflective component 104 from propellant in a casing of a cartridge (discussed in greater detail in conjunction with FIG. 6) that the projectile forms a part of. When the projectile 100 is fired from its cartridge casing, the wax coating 106 burns as the projectile 100 travels through a gun's barrel, thus protecting the highly reflective component 102 from the excessive heat of the propellant's rapid burn. The wax coating 106 also protects the highly reflective component 104 from corrosion by the propellant while the cartridge is stored before being fired. For another example, the protective component 102 may include a disk or plug 108 that simply falls away from the projectile as the projectile leaves a gun's barrel. For yet another example, the protective component 102 may include a sabot 110.

Figure 6:
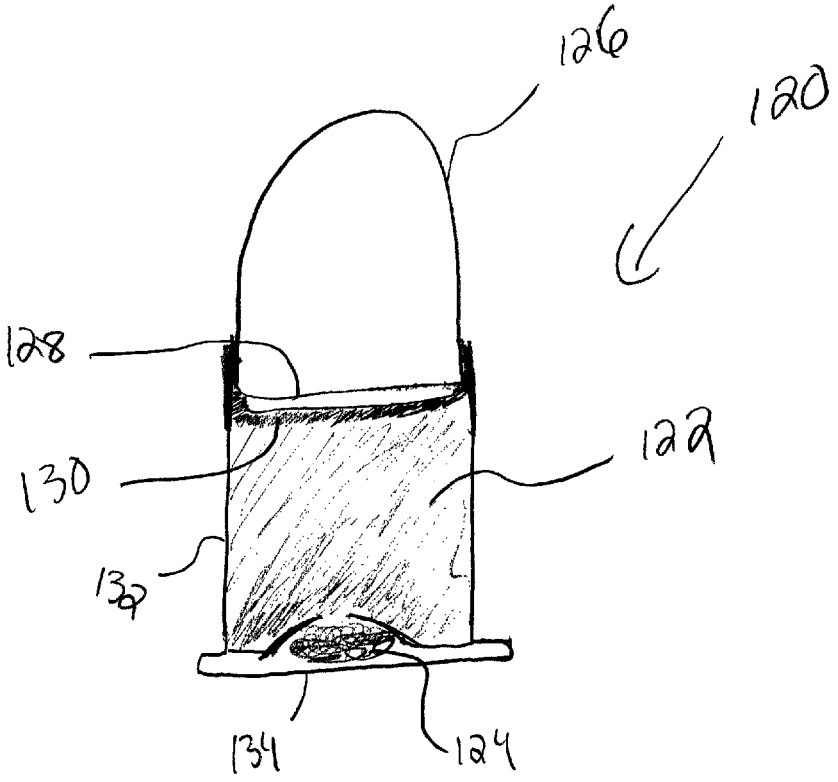
FIG. 6 shows a view of a cartridge, according to an embodiment of the invention.

FIG. 6 shows a view of a cartridge 120, according to an embodiment of the invention. The cartridge 120 includes propellant 122, primer 124, and a projectile 126 that has a highly reflective component 128 and a protective component 130. The cartridge 120 also includes a casing 132 to hold the propellant 122, primer 124, and projectile 126 until the projectile is to be fired from a gun. When the cartridge 120 is fired from a gun designed to fire the cartridge 120, the gun's firing pin strikes the back 134 of the casing 132 to ignite the primer 124. The burning primer then ignites the propellant 122 which burns very rapidly to quickly generate very high pressure inside the casing 132. The pressure inside the casing then urges the projectile 126 down the barrel of the gun away from the casing.

Although the cartridge 120 shown is configured for use in a handgun, the cartridge 120 may be configured as desired to be fired from any gun, such as a rifle, shotgun, or cannon.

Figure 7:
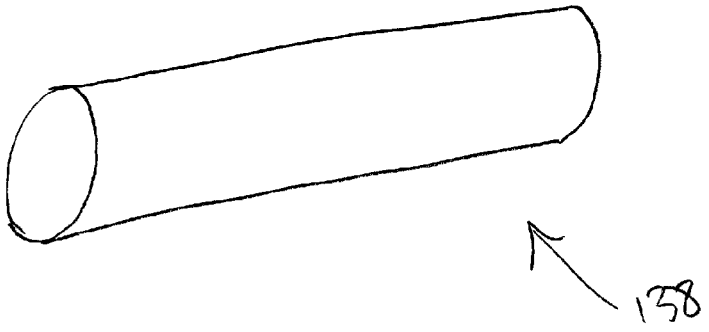
FIG. 7 shows a perspective view of an illuminator, according to an embodiment of the invention.

FIG. 7 shows a perspective view of an illuminator 138, according to an embodiment of the invention. The illuminator 138 generates electromagnetic radiation and directs the electromagnetic radiation toward a projectile 24 (FIG. 1) while the projectile 24 travels away from a gun 22 (FIG. 1).

The illuminator 138 may include any desired control circuitry and components to control one or more functions of the illuminator 138. For example, in this and other embodiments the illuminator 138 includes circuitry for causing the illuminator 138 to generate electromagnetic radiation when triggered as desired. In addition, the illuminator 138 also includes circuitry for causing the illuminator 138 to stop generating electromagnetic radiation when triggered as desired. Here, the illuminator 138 may be triggered to generate electromagnetic radiation when the control circuitry senses the firing of the gun. This may be accomplished by sensing the muzzle flash, noise, or acceleration of the gun upon firing the gun. To stop generating electromagnetic radiation, the control circuitry may be triggered by the passage of a predetermined period. The period may be adjustable to account for different ballistics and/or different range conditions. To avoid blinding the shooter from the reflection of a projectile that is very close to the gun, i.e., just starting down range, the illuminator's control circuitry may delay causing the illuminator 138 to generate electromagnetic radiation after the circuitry senses a firing event.

Other embodiments are possible. For example, the illuminator 138 may include control circuitry that modifies the intensity of the electromagnetic radiation it generates to reduce the brightness of the projectile's reflection when the projectile is very close to the gun. As another example, the illuminator may pulse (on/off) the electromagnetic radiation many times, such as thirty, while the projectile travels down range to reduce the brightness of the projectile's reflection.

What is claimed is:

1. A projectile comprising:

a component that is highly reflective and configured to reveal the projectile's trajectory when the projectile is fired from a gun and electromagnetic radiation is directed toward the projectile; and a protective component, that covers propellant that fires the projectile from a gun, and that protects the highly reflective component from damage while the projectile leaves a gun when the projectile is fired from the gun.

2. The projectile of claim 1 wherein the highly reflective component includes a retroreflector.

3. The projectile of claim 2 wherein the retroreflector includes at least one of the following: a corner reflector, a cat eye reflector, and a phase conjugate reflector.

4. The projectile of claim 1 wherein the projectile includes:

a body having a region that leaves the gun last when the projectile is fired from a gun, and the highly reflective component is located at the region of the body.

5. The projectile of claim 1 wherein the projectile includes a body and the highly reflective component is fastened to the body.

6. The projectile of claim 2 wherein the projectile includes:

a body, and tape that includes the retroreflector, and adheres to the body.

7. The projectile of claim 2 wherein the projectile includes:

a body having a surface, and the retroreflector is embossed on the surface.

8. The projectile of claim 1 wherein the projectile includes a body that is a solid mass of metal.

9. A cartridge for propelling a projectile out of a gun when the cartridge is fired, the cartridge comprising:

a casing;

a projectile held by the casing, and that includes a component that is highly reflective and configured to reveal the projectile's trajectory when the projectile is fired from a gun and electromagnetic radiation is directed toward the projectile;

a protective component to protect the highly reflective component from damage while the projectile leaves the casing when the cartridge is fired; and a propellant held by the casing, and configured to urge the projectile away from the casing when the cartridge is fired.

10. The cartridge of claim 9 wherein the highly reflective component includes a retroreflector.

11. The cartridge of claim 9 wherein the protective component includes a wax disposed between the projectile and the propellant.

12. The cartridge of claim 9 wherein the protective component includes a sabot.

13. The cartridge of claim 9 wherein the protective component includes a disk disposed between the projectile and the propellant.

14. The cartridge of claim 9 further comprising a plurality of projectiles, each including a component that is highly reflective.

15. A system for revealing a projectile's trajectory when the projectile is fired from a gun, the system comprising:

a projectile including a component that is highly reflective;

a protective component that covers propellant that fires the projectile from a gun and that protects the highly reflective component from damage while the projectile leaves the gun;

an illuminator configured to generate electromagnetic radiation and to direct the electromagnetic radiation toward the projectile while the projectile moves away from the gun that fired the projectile; and wherein the highly reflective component of the projectile is configured to reflect some of the electromagnetic radiation from the illuminator back in a direction from which the projectile came to reveal the projectile's trajectory.

16. The system of claim 15 wherein the component that is highly reflective includes a retroreflector.

17. The system of claim 15 wherein the illuminator generates one or more of the following: visible light, near infrared light, and a laser beam.

18. A method for revealing the trajectory of a projectile that is fired from a gun, the method comprising:

protecting, with a protective component that covers propellant that fires the projectile from a gun, a highly reflective component of a projectile while the projectile leaves a gun that fired the projectile;

directing electromagnetic radiation toward the projectile while the projectile moves away from the gun;

reflecting, with the highly reflective component of the projectile, a portion of the electromagnetic radiation; and sensing a portion of the electromagnetic radiation reflected by the highly reflective component.

19. The method of claim 18 wherein reflecting a portion of the electromagnetic radiation includes reflecting the portion with a retroreflector.

20. The method of claim 18 wherein sensing a portion of the reflected electromagnetic radiation includes a shooter of the projectile sensing a portion of the reflected electromagnetic radiation.

21. The projectile of claim 1 wherein the protective component includes a wax coating.

* * * * *